US006247965B1

(12) United States Patent
Cummings et al.

(10) Patent No.: US 6,247,965 B1
(45) Date of Patent: Jun. 19, 2001

(54) ELECTRICAL CONNECTOR HAVING SEALED SNAP-IN LOCKING CAVITY PLUGS

(75) Inventors: Douglas S. Cummings; Duane L. Brantingham, both of Cortland, OH (US); John M. Chupak, West Middlesex, PA (US); Christopher Adrian Margrave, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/455,056

(22) Filed: Dec. 6, 1999

(51) Int. Cl.[7] ..... H01R 13/40

(52) U.S. Cl. ..... 439/587; 439/274; 439/148; 439/744; 439/871

(58) Field of Search ..... 439/274, 275, 439/271, 587, 277, 148, 588, 589, 595, 744, 818, 871

(56) References Cited

U.S. PATENT DOCUMENTS 4,784,617 * 11/1988 Oda ..... 439/595

FOREIGN PATENT DOCUMENTS

374482 * 7/1991 (JP) .

* cited by examiner

*Primary Examiner*—Paula Bradley
*Assistant Examiner*—Truc Nguyen
(74) *Attorney, Agent, or Firm*—Richard A. Jones

(57) ABSTRACT

An electrical connector assembly includes male and female connector bodies formed with a plurality of locking cavities in which electrical cables are disposed with the terminal ends thereof secured against removal from the cavities by lock arms within the cavities engaging catches of the terminal ends. A seal on the cables closes and seals the cavities in which they are installed. At least one of the cavities is unoccupied by a cable and is closed by a non-electrical locking plug. The plug has a catch that engages the lock aim of the unoccupied cavities in which it is installed to secure the plug against removal and carries a seal which engages and seals the unoccupied cavities.

18 Claims, 3 Drawing Sheets

ELECTRICAL CONNECTOR HAVING SEALED SNAP-IN LOCKING CAVITY PLUGS

TECHNICAL FIELD

This invention relates generally to electrical connectors having mating male and female connector bodies, and more particularly to the manner of sealing unoccupied terminal cavities of the connectors.

RELATED PRIOR ART

Electrical connector assemblies of the type involved with the present invention include male and female connector bodies, each mounted to the ends of a plurality of electrical cables having mating terminals supported within passages of the respective connector bodies that, when the male and female connectors are joined, provide an electrical connection between the cooperating cables. The passages typically are formed with resilient lock arms that engage cooperating catches on the associated terminals to secure the terminals within the passages.

In some connector applications, it is desirable to seal the connector assembly to protect the terminals from exposure to the external environment. The connector bodies are each formed with a plurality of passages that extend into the connector bodies from the cable end in which the cables and their terminals are received. In a sealed connector application, a seal is provided about the cable that, when installed in the corresponding passage, serves to seal such passage from the outside environment. In some applications, not every passage is occupied by a corresponding cable. There may be, for example, an unequal number of cables occupying the passages of the respective male and female connector bodies. The male connector body may have four cables occupying four of its passages whereas the female cavity may only have two or three of its four passages occupied. In a sealed connector environment, it is necessary to seal the unoccupied cavity or cavities in order to protect the interior of the connector from exposure to the external atmosphere. The present known practice for sealing the unoccupied passages is to install a resiliently compressible elastomeric plug into the unoccupied passage or passages which relies for sealing and retention on a friction fit with the walls of the passages in which they are installed. It is an object of the present invention to provide a more secure means of sealing such unoccupied passages.

SUMMARY OF THE INVENTION AND ADVANTAGES

An electrical connector assembly constructed according to the invention includes male and female connector members having mateable plug and socket end portions, respectively. Each is formed with a plurality of locking cavities extending into the connector members from opposite cable ends thereof. A locking retainer is provided in each of the cavities. A plurality of electrical cables extend into less than all of the locking cavities such that at least one of the locking cavities is unoccupied . The cables have terminal ends that are formed with catches that engage the mating locking retainers of the cavities in which they are installed to lock the cables against removal. The terminal ends of the female connector member mate with at least some of the terminal ends of the male connector members when the connector members are fully assembled to establish an electrical connection therebetween. The cables are provided with annular seals that engage the walls of the cavities in which the cables are installed to seal such cavities.

According to a characterizing feature of the invention, the assembly includes at least one non-electrical cavity plug disposed in the unoccupied locking cavity. The plug has a seal that is operative to seal the unoccupied cavity and a catch that engages the locking retainer of the unoccupied cavity to secure the plug against removal therefrom.

The present invention has the advantage of providing a locking plug having a catch which engages the locking retainer of the unoccupied cavity in which it is installed to positively lock the plug against inadvertent removal from the cavity. Such a plug does not rely solely on a friction fit within the locking cavity for retention, but takes advantage of the locking retainer already provided for locking the electrical terminals as a means of positively securing the locking plug within the unoccupied cavity.

BRIEF DESCRIPTION OF THE DRAWINGS

A presently preferred embodiment of the invention is disclosed in the following description and in the accompanying drawings, in which.

DETAILED DESCRIPTION

Figure 1:
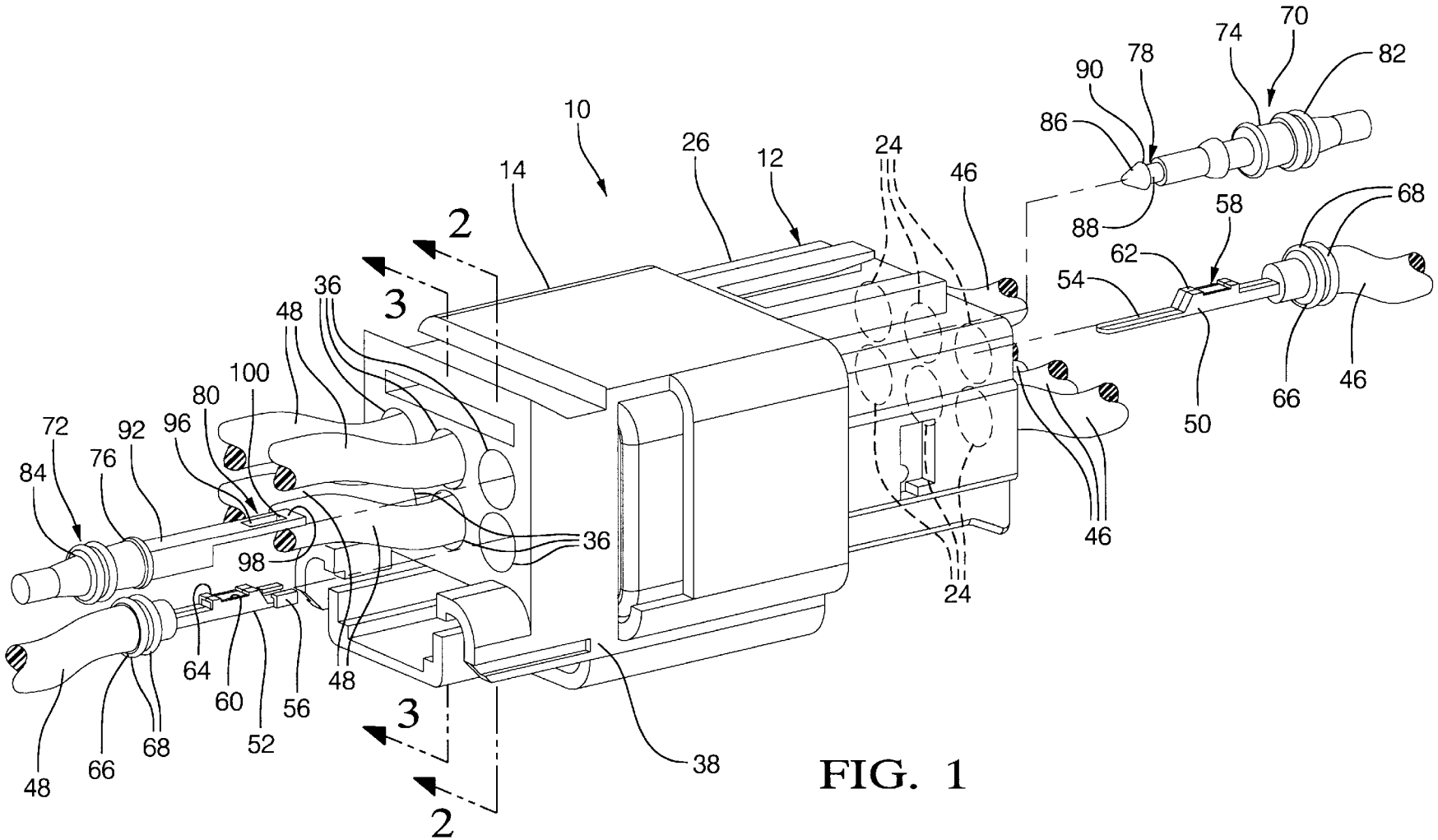
FIG. 1 illustrates an enlarged fragmentary exploded perspective view of an electrical connector assembly having locking cavity plugs constructed according to the invention.

An electrical connector apparatus constructed according to a presently preferred embodiment of the invention is shown generally at 10 in the drawings, and comprises a male connector member 12 and a mating female connector member 14. The connector members 12, 14 are molded of a rigid plastics material. The male connector 12 is formed with a plug end 16 and the female connector 14 is formed with a cooperating socket end 18 into which the plug end 16 is inserted for assembling the connectors 12, 14, as shown in the drawings. A lock arm 20 of the female connector 14 engages a locking projection 22 provided on the male connector 12 for securing the connectors 12, 14 in the fully assembled condition.

The male connector 12 is formed with a plurality of locking passages or cavities 24 extending longitudinally into the male connector 12 from an opposite cable end 26 of the male connector. The locking cavities 24 include a generally cylindrical sealing wall portion 28 adjacent the cable end 26 and a locking retainer in the preferred form of a resilient lock arm 30 projecting into each cavity 24 from a wall thereof and extending in cantilevered fashion toward the socket end. The lock arm 30 has a locking projection 32 defining a lock shoulder 34 adjacent the free end of the lock arm 30. The locking cavities 24 are preferably identical in construction.

The female connector 14 is formed with a plurality of locking cavities 36, all of identical construction, extending into the female connector 14 from an opposite cable end 38 thereof, and aligned coaxially with the locking cavities 24 of the male connector 12. The female locking cavities 36 likewise include cylindrical sealing walls 40 adjacent the cable end 38 and a locking retainer in the preferred form of a lock arm 42 of the same construction as the lock arm 30, including the provision of a locking projection 43 adjacent its free end presenting a lock shoulder 44.

A plurality of electrical cables 46 occupy at least some of the locking cavities 24 of the male connector 12, and another plurality of cables 48 occupy at lease some of the locking cavities 36 of the female connector 14. The cables 46, 48 extend into their respective cavities 24, 36 through the open cable end 26, 38 thereof, and have terminal ends 50, 52 disposed within the connectors 12, 14, at least some of which mate when the connectors 12, 14 are joined to establish an electrical connection between the mating cables 46, 48. The terminal ends 50 of the male cables 46 have elongated blades 54 that project beyond the cavities 24 of the male connector 12 into the cavities 36 of the female connector 14 in overlapping relation to the terminal ends 52 of the female cables 48. The terminal ends 52 of the female cables 48 are formed with receptacle portions 56 which wrap around and frictionally engage the blades 54 to establish metal-to-metal electrical contact therebetween. It will be seen that the terminal ends 52 of the female cables 48 are contained within the locking cavities 36 of the female connector 14 and as such do not project into the locking cavities 24 of the male connector 12.

The terminal ends 50, 52 are formed with catches 58, 60, respectively, that, when the terminal ends 50, 52 are fully inserted into the locking cavities 24, 36, engage the lock arms 20, 30 to secure the cables 46, 48 against removal from the locking cavities 24, 36. As the terminal ends 50, 52 are extended into the locking cavities 24, 36, the leading end or head of the terminal ends 50, 52 engage the ramped side of the locking projections 32, 43, deflecting the lock arms 30, 42 laterally outwardly, until such time as the projections 32, 43 drop into a recess or detent defining the catches 58, 60. The catches 58, 60 present locking shoulders 62, 64 that confront the locking shoulders 34,44 of the lock arms 30, 42 to secure the terminal ends 50, 52 of the cables 46, 48 from withdrawal from the locking cavities 24, 36.

Each of the cables 46, 48 is provided with a seal 66 in the preferred form of an annular sleeve having at least one and preferably a plurality of annular ribs or lips 68 engaging the cylindrical walls 28, 40 of the locking cavities 24, 36 to seal the cavities 24, 36 from exposure to the external atmosphere in order to prevent moisture, dirt, and other contaminants from injuring the connector assembly 10.

The connector assembly thus far described is conventional, and is representative of the typical sealed electrical connector wherein the terminal ends 50, 52 of the cables 46, 48 lock within the cavities and seal the cavities from the outside atmosphere. In many applications, less than all of the locking cavities 24, 36 are occupied by such cables 46, 48. In sealed connector applications, the unoccupied cavity or cavities must nonetheless be sealed to maintain a sealed environment within the connector assembly 10. In the illustrated embodiment, the male connector member 12 has one cavity that is unoccupied by a cable, and is designated $\mathbf{24}_u$ in FIGS. 1 and 3. The female connector 14 also has one of its cavities unoccupied by a cable, designated at $\mathbf{36}_u$ in FIGS. 1 and 2. In each case, the cavity of the other connector aligned with the unoccupied cavities $\mathbf{24}_u$, $\mathbf{36}_u$ is occupied by either a female 52 or male 50 terminal end, respectively, which is not electrically active, but nonetheless supported by the connector assembly 10.

Figure 2:
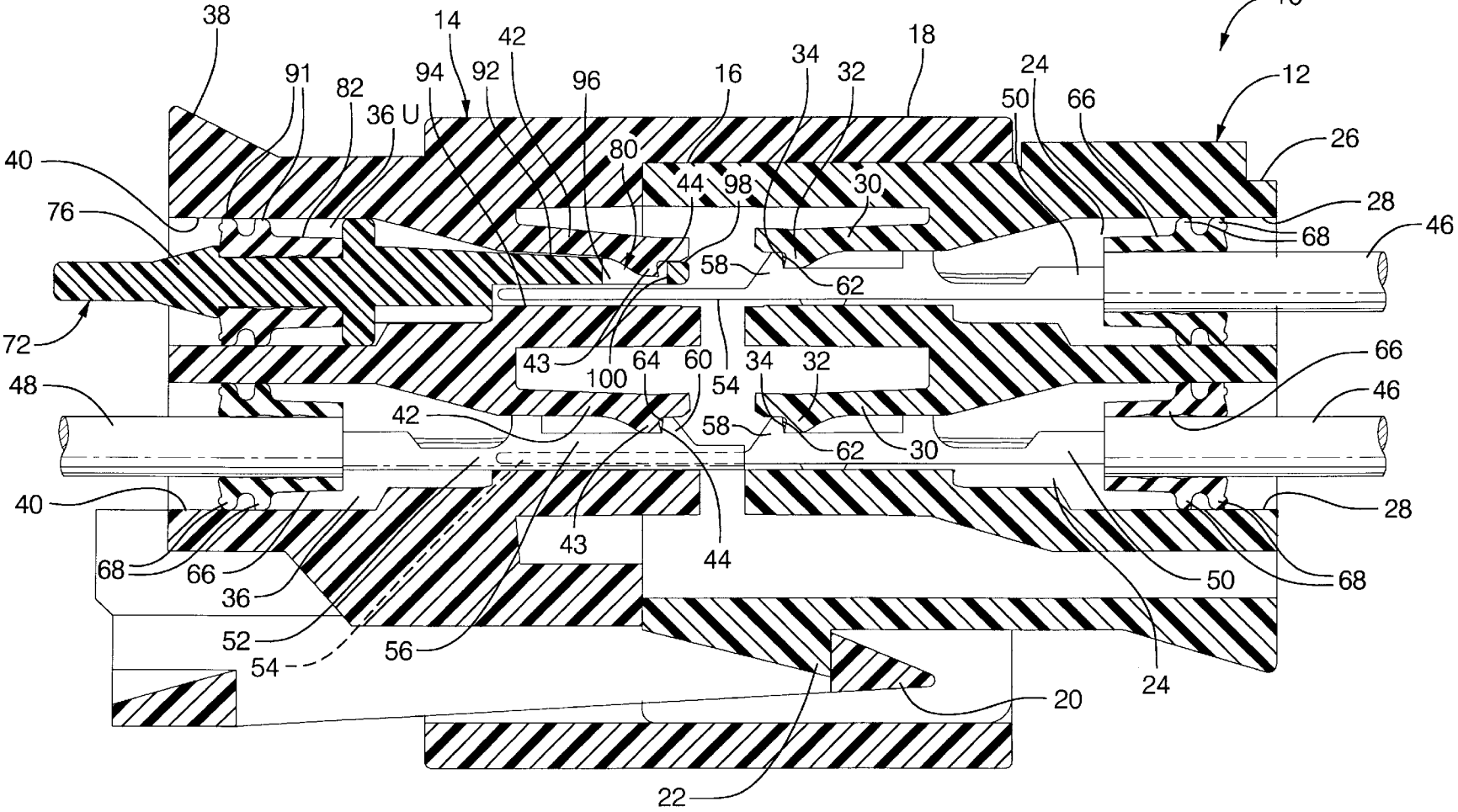
FIG. 2 is an enlarged fragmentary cross-sectional view taken along lines 2—2 of FIG. 1.
Figure 3:
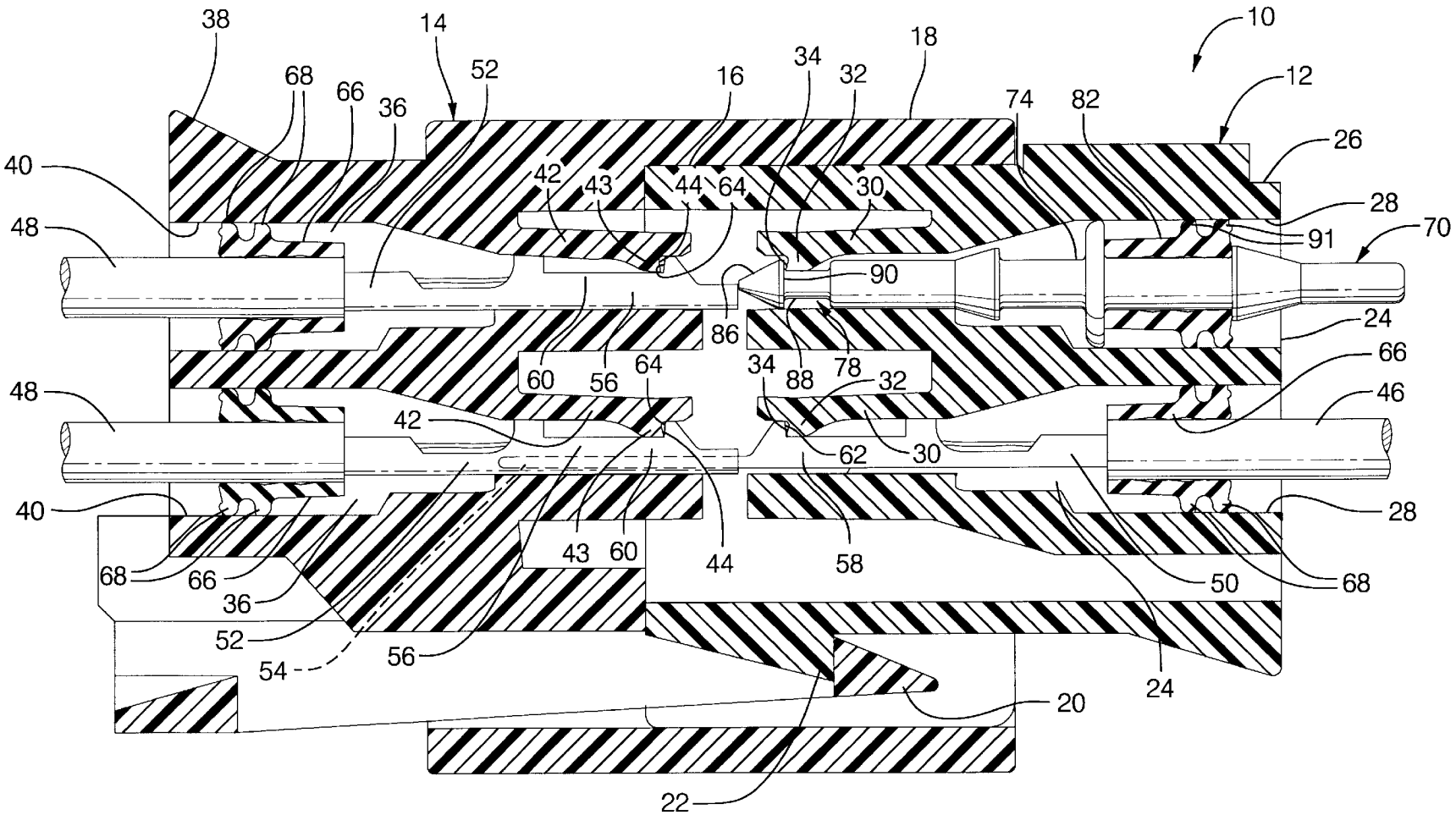
FIG. 3 is an enlarged longitudinal sectional view taken along line 3—3 of FIG. 2.

According to the invention, locking plugs 70, 72 are provided and installed in the unoccupied locking cavities $\mathbf{24}_u$, $\mathbf{36}_u$ of the male and female connectors 12, 14, respectively. The locking plugs 70, 72 have elongate, rigid plastic bodies 74, 76 formed with catches 78, 80 adjacent their leading ends, and seals 82 adjacent their trailing ends. As shown in FIGS. 1 and 3, the leading end of the male locking plug 70 has an enlarged, preferably conical head 86 that, when extended into the unoccupied cavity $\mathbf{24}_u$ confronts the locking projection 32 upon installation. As the head 86 passes across the projection 32, it deflects the projection 32 first outwardly and then allows it to return inwardly where the projection 32 drops into a reduced diameter section 88 behind the head 86, bringing the lock shoulder 34 of the projection 32 into confronting engagement with an annular outer shoulder 90 of the head 86 to provide the catch 78. Such engagement of the shoulders 34, 90 locks the plug 70 within the unoccupied cavity $\mathbf{24}_u$ in much the same way as the terminal ends 50 are secured. The conical configuration of the head 86 and the annular configuration of the shoulder 90 enables the plug 70 to be installed and engaged by the lock arm 30 regardless of the rotational orientation of the plug 70 relative to the cavity $\mathbf{24}_u$. The seal 82 preferably comprises an annular sleeve disposed about the body 74 and the plug 70 sealingly engaging the cylindrical wall 28 of the unoccupied cavity $\mathbf{24}_u$. The seal 82 preferably is of identical construction to the seals 66 of the cables 46, 48, and thus includes at least one, and preferably a plurality of radial outer ribs or lips 91 that engage and seal the wall 28 and thus close the unoccupied cavity $\mathbf{24}_u$. The seal 82 is fabricated of a resiliently compressible plastics material different than that used for the rigid plastics plug body 74. The seal 82 is preferably annular and thus permits installation of the locking plug 70 without regard to rotational orientation to achieve both locking and sealing within the unoccupied cavity $\mathbf{24}_u$.

It will be seen from FIG. 3 that the head 86 of the locking plug 70 is accommodated within the cavity $\mathbf{24}_u$ without interference from the companion female terminal end 52 of the axially adjacent occupied cavity 36 of the female connector 14.

Referring now to FIGS. 1 and 3, the female locking plug 72 disposed in the unoccupied cavity $\mathbf{36}_u$ of the female connector 14 is preferably of identical construction to that of the locking plug 70 except for the construction of the locking head 92 and catch 80. Instead of the head 90 having a conical configuration that occupies and blocks the full width of the cavity opening, the locking head 92 of the female plug 72 has preferably a flat, blade-like configuration having a thickness dimensioned to leave sufficient space between the blade-like locking head 92 and an opposing wall 94 of the cavity $\mathbf{36}_u$ to accommodate the extension of the male terminal blade 54 of the companion male connector 12 within the unoccupied female cavity $\mathbf{36}_u$ in overlapping relation to the paddle-like locking head 92. The locking head 92 has a catch-defining opening 96 closed at the leading end of the head 92 by a crossbar 98 which ramps up and over the locking projection 43 of the lock arm 42 for receiving the projection 43 into the opening 96. The shoulder 44 of the lock arm 42 confronts a corresponding shoulder 100 of the crossbar 98 to lock the plug 72 within the unoccupied cavity $\mathbf{36}_u$. The seal 84 is identical to the seal 82 and function in the same manner.

The invention thus provides a means of sealing the unoccupied cavities of male and female connector members 12, 14 by means of locking plugs 70, 72 formed with catches 78, 80 that engage the pre-existing lock arms 30, 42 of the cavities $\mathbf{24}_u$, $\mathbf{36}_u$ to lock the plugs 70, 72 against removal from the cavities $\mathbf{24}_u$, $\mathbf{36}_u$, ensuring that the connector assembly 30 remains weather-tight during the full service life.

The disclosed embodiments are representative of presently preferred forms of the invention, but are intended to be illustrative rather than definitive thereof. The invention is defined in the claims.

What is claimed is:

1. An electrical connector assembly comprising:

male and female connector members having mateable plug and socket end portions, respectively, and each formed with a plurality of locking cavities extending into said connector members from opposite cable ends thereof;

a locking retainer provided in each of said cavities;

a plurality of electrical cables extending into less than all of said locking cavities such that at least one such locking cavity is unoccupied by an associated electrical cable;

said cables having associated terminal ends formed with catches engaging said locking retainer of said cavities in which said cables are installed to lock said cables against removal from said cavities, said terminal end of said female connector member mating with at least some of said terminal ends of said male connector member when said connector member are fully assembled to establish an electrical connection between said mated terminal ends;

said cables having seals operative to seal said cavities in which said cables are installed; and at least one non-electrical cavity plug disposed in said at least one of said unoccupied locking cavities having an associated seal operative to seal such unoccupied cavity, and a catch engaging said locking retainer of said unoccupied cavity securing said plug against removal from said unoccupied cavity.

said seal comprising a hollow annular sleeve or resiliently compressible material having a bore extending between a first and second open ends; and the plug including an elongated body of rigid plastic material with the associated seal disposed about the elongated body so that the elongated body extends through the first and second open ends of the hollow annular sleeve to provide an exposed end portion.

2. The assembly of claim 1 wherein said elongate body of rigid plastics material has a lock head adjacent an inserted end of said plug formed with said catch for engaging said locking retainer.

3. The assembly of claim 2 wherein plug is configured to lock within and seal said unoccupied cavity irrespective of the rotational orientation of said plug about a longitudinal axis thereof relative to said unoccupied cavity.

4. The assembly of claim 1 wherein said plug includes a generally conical lock head and said catch of said plug comprises an annular shoulder of said head engaging a cooperating shoulder of said locking retainer.

5. The assembly of claim 4 wherein said locking cavities of said female and male connector bodies are axially aligned, and said cavity of the companion connector member aligned with said unoccupied cavity of the other connector member in which said plug is installed has an associated one of said cables installed therein with said terminal end thereof supported in non-interfering relation with said plug when said connector members are fully assembled.

6. The assembly of claim 1 wherein said terminal end of said plug has a generally flat, elongate paddle configuration and said catch of said plug comprises a shoulder of said paddle end engaging a cooperating shoulder of said locking retainer.

7. The assembly of claim 6 wherein said locking cavities of said female and male connector bodies are axially aligned, and said cavity of the companion connector member aligned with said unoccupied cavity of the other connector member in which said plug is installed has an associated one of said cables installed therein with said terminal end thereof extending into said cavity of said other connector member in overlapping relation to said paddle end of said plug.

8. The assembly of claim 7 wherein said paddle end is dimensioned relative to said unoccupied cavity to provide sufficient clearance between said paddle end and an opposing wall of said unoccupied cavity to accommodate said extension of said associated terminal end of the companion connector within said unoccupied cavity in said overlapping relation to said paddle end.

9. The assembly of claim 1 wherein said locking retainers of said locking cavities comprise resilient lock arms.

10. The assembly of claim 1 wherein the annular sleeve is disposed about a cylindrical portion of the elongate body between longitudinally spaced radial enlargements of the elongate body.

11. The assembly of claim 10 wherein said seal of said plug and said seals of said cables are identical in construction.

12. The assembly of claim 1 wherein said connector members include mateable locking features that engage when said connector member are fully assembled with one another to secure said connectors members in said fully assembled condition.

13. The assembly of claim 1 wherein said locking cavities each have a substantially cylindrical wall section adjacent said cable end of said connector members for sealing.

14. A method of sealing an unoccupied locking cavity of an electrical connector assembly of the type including matable male and female connector members each having a plurality of locking cavities extending into each of the connector members from a cable end thereof, a plurality of electrical cables disposed in at least some of the locking cavities and having cooperating terminal ends at least some of which mate when the connector members are joined to establish an electrical connection therebetween, a locking retainer provided in each of the cavities, a catch provided on each of the terminal end of the cables engaging the locking retainers of the cavities in which they are installed to secure the cables against removal from the cavities, a seal provided on each of the cables operative to seal the cavities in which the cables are installed, and wherein at least one of the cable cavities is unoccupied by a cable, said method comprising:

providing a seal comprising a hollow annular sleeve of resiliently compressible material having a bore extending between a first and second open ends; and providing a non-electrical cavity plug including an elongated body of rigid plastic material with the associated seal disposed about the elongated body so that the elongated body extends through the first and second open ends of the hollow annular sleeve to provide an exposed end portion and a catch; and extending the plug into the at least one unoccupied cavity such that the seal of the plug operates to seal the unoccupied cavity, and the catch of the plug engages the locking retainer of the unoccupied cavity securing the plug against removal from the unoccupied cavity.

15. The method of claim 14 including forming the catch of the plug as an outer annular shoulder of the plug.

16. The method of claim 14 including forming the plug to include a generally flat, paddle end having a locking shoulder defining said catch of the plug engagable with said locking retainer of the unoccupied cavity.

17. The method of claim 16 including dimensioning the paddle end to provide sufficient clearance within the unoccupied cavity to receive the terminal end of the companion connector therein in overlapping relation to the paddle end when the connectors are assembled.

18. An electrical connector assembly comprising:

a connector member having a plurality of locking cavities extending into said connector member from a cable end thereof;

a locking retainer provided in each of said cavities;

a plurality of electrical cables extending into less than all of said locking cavities such that at least one such locking cavity is unoccupied by an associated electrical cable;

said cables having associated terminal ends formed with catches engaging said locking retainer of said cavities in which said cables are installed to lock said cables against removal from said cavities, said cables having seals operative to seal said cavities in which said cables are installed; and at least one non-electrical cavity plug disposed in said at least one of said unoccupied locking cavities having an associated seal operative to seal such unoccupied cavity, and a catch engaging said locking retainer of said unoccupied cavity securing said plug against removal from said unoccupied cavity, the non-electrical cavity plug including an elongate body of rigid plastics material and the associated seal comprising an annular sleeve of resiliently compressible material disposed about the elongate body so that the elongate body extends through the sleeve to provide an exposed end portion, the annular sleeve of resiliently compressible material being disposed about a cylindrical portion of the elongate body between longitudinally spaced radial enlargements of the elongate body, and the associated seal being identical to the seals of the cables.

* * * * *